US012656058B2

(12) United States Patent
Mikhelson et al.

(10) Patent No.: US 12,656,058 B2
(45) Date of Patent: Jun. 16, 2026

(54) LIQUEFIED NATURAL GAS PRODUCTION FACILITY ON GRAVITY-BASED STRUCTURES

(71) Applicant: Publichnoe Aktsionernoe Obshchestvo "NOVATEK", Tarko-Sale (RU)

(72) Inventors: Leonid Viktorovich Mikhelson, Moscow (RU); Valeriy Nikolaevich Retivov, Moscow (RU); Sergey Gennadyevich Solovyev, Novyy Urengoy (RU)

(73) Assignee: Publichnoe Aktsionernoe Obshchestvo "NOVATEK", Tarko-Sale (RU)

( * ) Notice: Subject to any disclaimer, the term of this patent is extended or adjusted under 35 U.S.C. 154(b) by 137 days.

(21) Appl. No.: 18/851,826

(22) PCT Filed: Nov. 9, 2022

(86) PCT No.: PCT/RU2022/000332
§ 371 (c)(1),
(2) Date: Sep. 27, 2024

(87) PCT Pub. No.: WO2023/249510
PCT Pub. Date: Dec. 28, 2023

(65) Prior Publication Data

US 2025/0198696 A1 Jun. 19, 2025

(30) Foreign Application Priority Data

Jun. 20, 2022 (RU) ..... RU2022116595

(51) Int. Cl.
*F25J 1/02* (2006.01)
*F25J 1/00* (2006.01)

(52) U.S. Cl.
CPC ..... *F25J 1/0269* (2013.01); *F25J 1/0022* (2013.01); *F25J 1/0212* (2013.01); *F25J 1/0234* (2013.01); *F25J 2220/66* (2013.01)

(58) Field of Classification Search
CPC ..... F25J 1/0269; F25J 1/0022; F25J 1/0212; F25J 1/0234; F25J 2220/66
See application file for complete search history.

(56) References Cited

U.S. PATENT DOCUMENTS

2016/0010916 A1 1/2016 Byfield
2016/0231050 A1 8/2016 Faka
2020/0309450 A1* 10/2020 Morley ..... F25J 1/0244

FOREIGN PATENT DOCUMENTS

AU 2012207059 A1 8/2012

OTHER PUBLICATIONS

International Search Report in PCT/RU2022/000332, mailed Apr. 13, 2023.

(Continued)

*Primary Examiner* — Jonathan Bradford
(74) *Attorney, Agent, or Firm* — Collard & Roe, P.C.

(57) ABSTRACT

A liquefied natural gas (LNG) production facility includes gravity-based structures (GBSs) with process lines for liquefying natural gas. A GBS contains: tanks for each component of a mixed refrigerant, wherein a GBS process line includes a fractionating apparatus for mixed refrigerant component production from a broad fraction of light hydrocarbons; a stabilized gas condensate (SGC) storage tank; and a berth for offloading LNG and SGC into tankers. Each GBS contains an LNG storage tank. One tank per mixed refrigerant component from each GBS is connected by pipe to systems for preparing and compressing all process line refrigerants, thus forming a common component feed system. The SGC storage tank is connected by pipes to condensate-stabilizing apparatus for all process lines, thus form- (Continued)

ing a common system for storing and offloading SGC. The LNG storage tanks are interconnected by pipes, forming a common system for storing and offloading LNG.

10 Claims, 11 Drawing Sheets

(56) References Cited

OTHER PUBLICATIONS

Arctic LNG 2 project. Environmental, social and health impact assessment. Non-technical summary. Prepared by Ramboll CIS. Aug. 2020, pp. 10-12. http://arcticspg.ru/%D0%A0%D0%B5%D0%B7%D1%8E%D0%BC%D0%B5%20%D0%BD%D0%B5%D1%82%D0%B5%D1%85%D0%BD%D0%B8%D1%87%D0%B5%D1%81%D0%BA%D0%BE%D0%B3%D0%BE%20%D1%85%D0%B0%D1%80%D0%B0%D0%BA%D1%82%D0%B5%D1%80%D0%B0/Arctic%20LNG%202%20NTS%20v3_final%20report_RUS_clean.pdf. (See Specification and ISR for relevance).
English translation of previously submitted Arctic LNG 2 project. Environmental, social and health impact assessment. Non-technical summary. Prepared by Ramboll CIS. Aug. 2020, pp. 10-12. http://arcticspg.ru/%D0%A0%D0%B5%D0%B7%D1%8E%D0%BC%D0%B5%20%D0%BD%D0%B5%D1%82%D0%B5%D1%85%D0%BD%D0%B8%D1%87%D0%B5%D1%81%D0%BA%D0%BE%D0%B3%D0%BE%20%D1%85%D0%B0%D1%80%D0%B0%D0%BA%D1%82%D0%B5%D1%80%D0%B0/Arctic%20LNG%202%20NTS%20v3_final%20report_RUS_clean.pdf.

* cited by examiner

LIQUEFIED NATURAL GAS PRODUCTION FACILITY ON GRAVITY-BASED STRUCTURES

CROSS REFERENCE TO RELATED APPLICATIONS

This application is the National Stage of PCT/RU2022/000332 filed on Nov. 9, 2022, which claims priority under 35 U.S.C. § 119 of Russian Application No. 2022116595 filed on Jun. 20, 2022, the disclosure of which is incorporated by reference. The international application under PCT article 21(2) was not published in English.

FIELD OF ART

The invention pertains to production facilities and can be used for development of near-shore and offshore integrated liquefied natural gas (LNG) production complexes on gravity-based structures.

BACKGROUND ART

There are several types of near-shore and offshore hydrocarbon processing plants, for instance natural gas liquefaction plants (LNG plants) on floating and gravity-based substructures.

A common design is an LNG production complex, which is a floating natural gas production, treatment, liquefaction, LNG storage and offloading installation. Floating installations for production, storage, and offloading of LNG (FLNG) are used of offshore gas field developments and is installed directly at the offshore field using anchoring and/or mooring. Such floating installations are not operated in offshore locations with heavy ice conditions since their reliable positioning necessary to connect to valves on underwater pipes is impossible due to the drifting ice, therefore floating LNG plant applications are limited to offshore field development in ice-free seas. Furthermore, production capacity of floating installations is limited by their size, they can only accommodate a single production line requiring the full set of primary and auxiliary equipment to support the line operation and at the same time limiting the critical equipment sparing options.

One example of an LNG plant on a gravity-based structure (GBS) is a near-shore LNG production, storage, and offloading plant (US 2016/0231050 A1, publication date: 2016 Aug. 11) with liquefaction equipment installed on a top deck of the gravity-based structure, and the plant capacity may be expanded by installing additional equipment in pre-existing areas of the GBS top slab and/or by using additional process installations mounted on their dedicated base structures resting on a seabed or on a shore near the GBS, which accommodates most of the process equipment. This design features the following disadvantages.

1. Large-size GBS to accommodate additional equipment.
2. Equipment belonging to the same production line is distributed across several locations, meaning longer pipe and cable runs and a more complicated plant operation.
3. Equipment duplication in case of capacity expansion.
4. Equipment of individual production lines cannot be used for sparing purposes of the production complex as a whole.

A complex design, which is the closest to the proposed one, features an LNG plant on three gravity-based structures (GBS), each accommodating an individual production line (Arctic LNG 2 project. Environmental, social and health impact assessment. Non-technical summary. Prepared by Ramboll CIS. August 2020, pages 10-12. http://arcticspg.ru/%D0%A0%D0%B5%D0%B7%D1%8E%D0%BC%D0%B59%20%D0%BD%D0%B5%D1%82%D0%B5%D1%85%D0%BD%D0%B8%D1%87%D0%B5%D1%81%D0%BA%D0%BE%D0%B3%D0%BE%20%D1%85%D0%B0%D1%80%D0%B0%D0%BA%D1%82%D0%B5%D1%80%D0%B0/Arctic%20LNG%202%20NTS%20v3_final %20 report_RUS_clean.pdf). The LNG plant comprises three gravity-based structures (GBS), each accommodating a natural gas liquefaction line relying on a mixed refrigerant, including gas condensate stabilization installations, a mercury removal installation, acid gas removal and dehydration installations, wide fraction of light hydrocarbons (WFLH) extraction installations, and a liquefaction installation and a fractionation installation for generation of mixed refrigerant components from WFLH, each GBS having at least one LNG storage tank and at least one stable gas condensate (SGC) storage tank, and each GBS also having at least one tank for each mixed refrigerant component as well as an LNG and SGC offloading jetty.

The disadvantage of this facility is that process equipment is triplicated across the three production lines as well as that there is no possibility to use an individual line equipment for sparing of the production complex equipment as a whole.

SUMMARY OF THE INVENTION

The proposed invention offers a solution for the technical problem of equipment duplication in LNG production complexes comprising two or more production lines, each accommodated on a dedicated GBS.

Technical result accomplished by the invention is enabling the avoidance of excess equipment duplication by developing shared-use technical systems for the entire complex. Certain design options for the complex also enable the necessary sparing of critical systems by using equipment on a GBS to sustain the operation of production lines accommodated on other GBS.

The technical result is delivered as a liquefied natural gas (LNG) production complex comprising at least two GBS, each accommodating a natural gas liquefaction production line using a mixed refrigerant, including raw gas reception and treatment installations, a gas condensate stabilization installation, gas dehydration and mercury removal installations, a wide fraction of light hydrocarbons (WFLH) extraction installation, a refrigerants treatment and compression system, and a liquefaction installation, with at least one GBS production line incorporating a fractionation installation to generate mixed refrigerant components from WFLH, and at least one respective GBS having at least one storage tank for each mixed refrigerant component. Each GBS has at least one LNG storage tank. At least one GBS has at least one stable gas condensate (SGC) storage tank. At least one GBS has a jetty for offloading LNG and SGC into tankers.

In accordance with the invention, at least one of each tank for each mixed refrigerant component has pipeline connections to the refrigerant treatment and compressions systems of each production line to form a single mixed refrigerant components replenishment system, at least one SGC storage tank has a pipeline connection to condensate stabilization installations of all the production lines to form a single SGC storage and offloading system, and the LNG storage tanks have a pipeline interconnection to form a single LNG storage and offloading system.

There are following design options for the complex.

The complex may comprise two GBS, with the said fractionation installation being installed on one, or each of the two production lines, and at least one said tank for each mixed refrigerant component being installed in one, or each of the two GBS.

The complex may comprise at least three GBS, with the said fractionation installations being installed on at least two production lines, and at least one of each said tank for each mixed refrigerant component being installed in at least two respective GBS.

For a two-GBS complex, at least one said SGC storage tank is installed in one, or each, of the two GBS.

For a three or more GBS complex, at least one SGC storage tank is installed in at least two GBS.

Furthermore, for a three or more GBS complex, the jetties for offloading LNG and SGC are available at least on two GBS.

Each production line may comprise a nitrogen system, including an air separation installation, a nitrogen storage tank and a nitrogen vaporizer, with one of the production lines also having a backup air separation installation, and the nitrogen systems having a pipeline interconnection to form a single nitrogen supply system.

Each production line may comprise air compressor installations, with two of the production lines having a backup air compressors installation, and the air compressors installations having a pipeline interconnection to form a single compressed air supply system.

Each production line may comprise an air dryer installation, with two of the production lines having a backup air dryers installation, and the air dryers installations having a pipeline interconnection to form a single dry air system.

It is advisable that each GBS has a power plant, with all the power plants having a cable interconnection to form a single power supply system, each power plant having gas turbine generators (GTGs), and two of the power plants each having a backup GTG.

LIST OF DRAWINGS

EXAMPLES OF IMPLEMENTATION OF THE INVENTION

The liquefied natural gas (LNG) production complex on gravity-based structures (GBS) is a combination of process, engineering and auxiliary equipment for production, storage and offloading of LNG and SGC. The complex may comprise two or more production lines on gravity-based structures (GBS).

Figure 1:
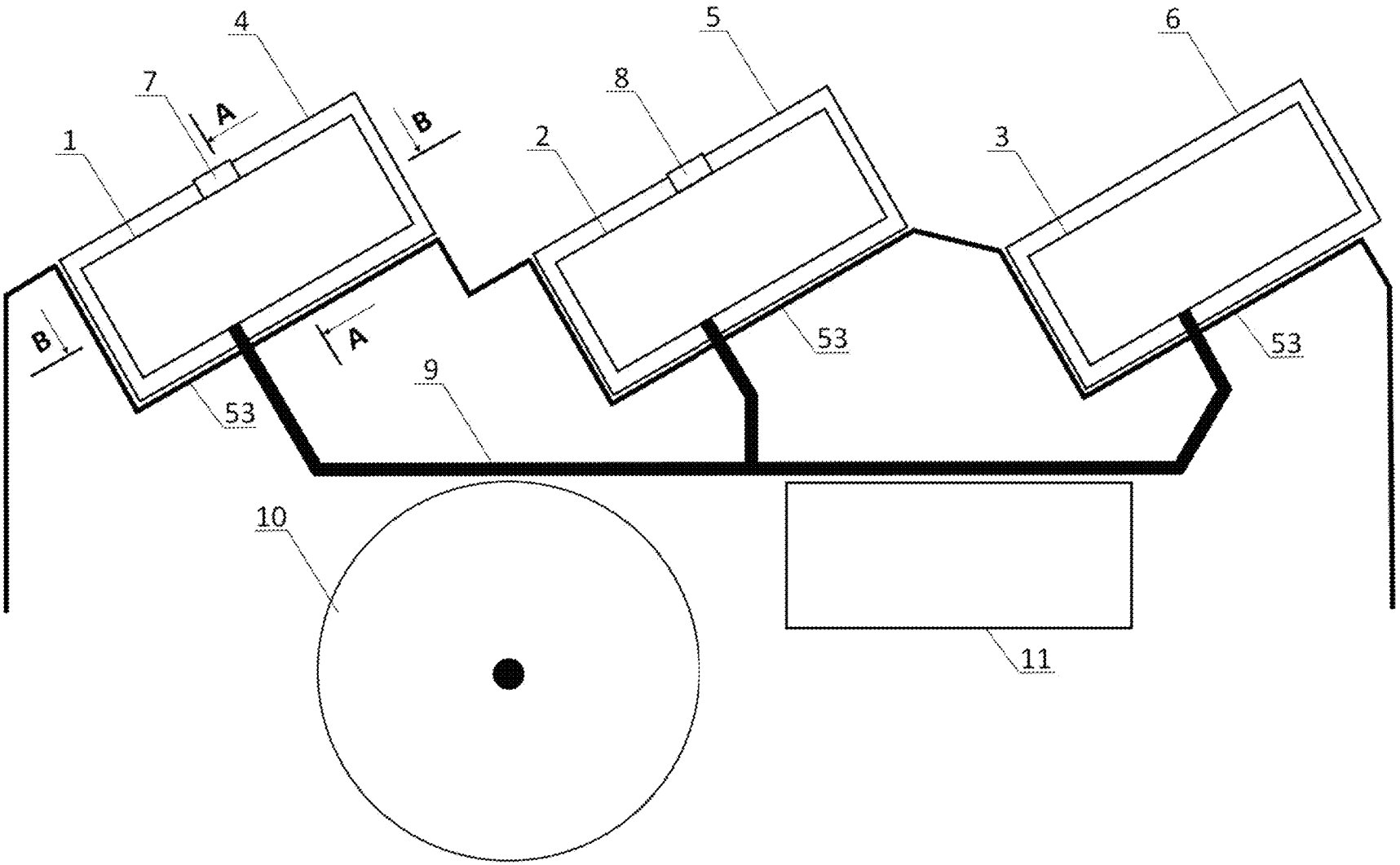
FIG. 1 shows a scheme of the production complex on GBS.
Figure 2:
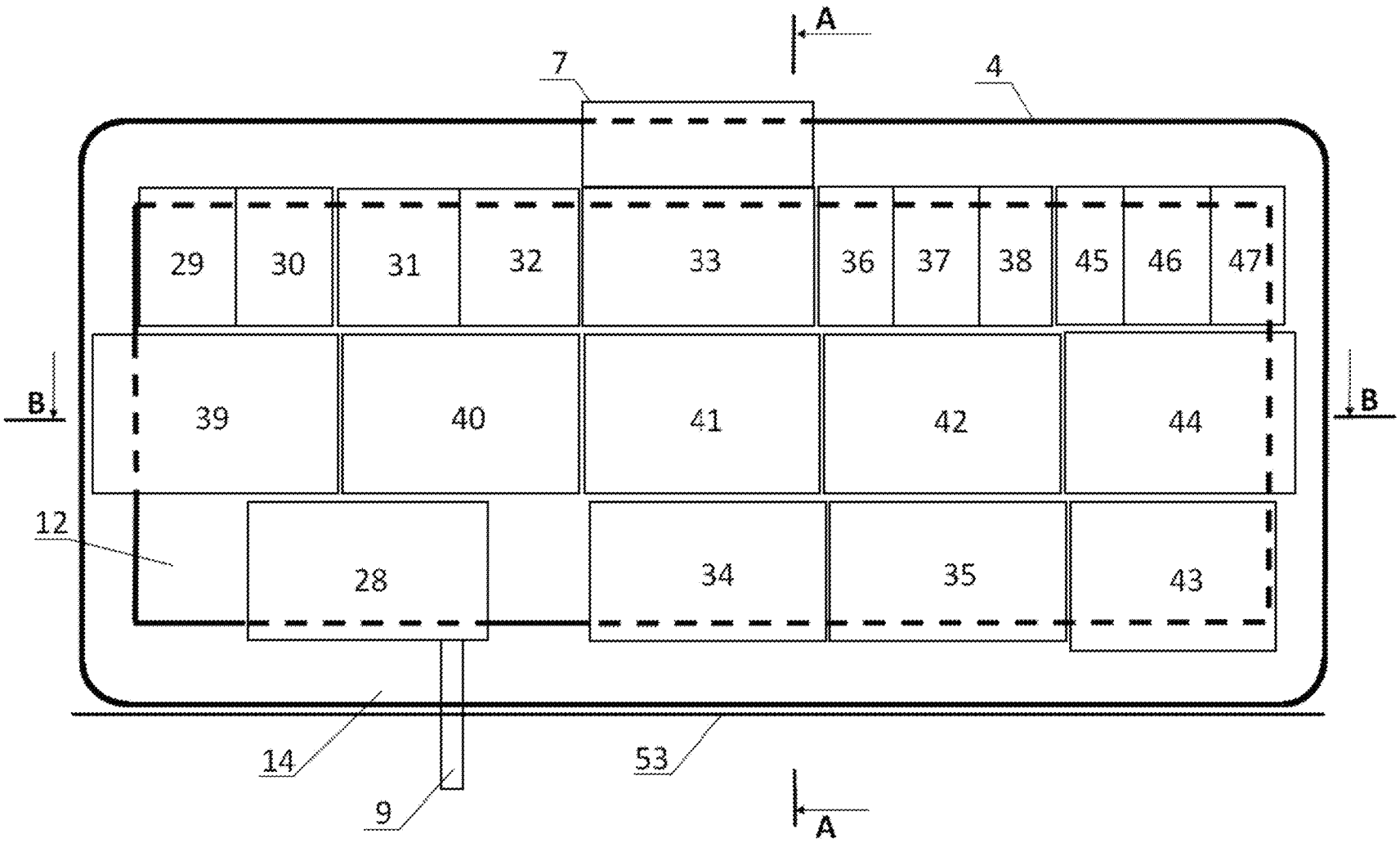
FIG. 2 shows a scheme of the GBS production line, view from above.
Figure 3:
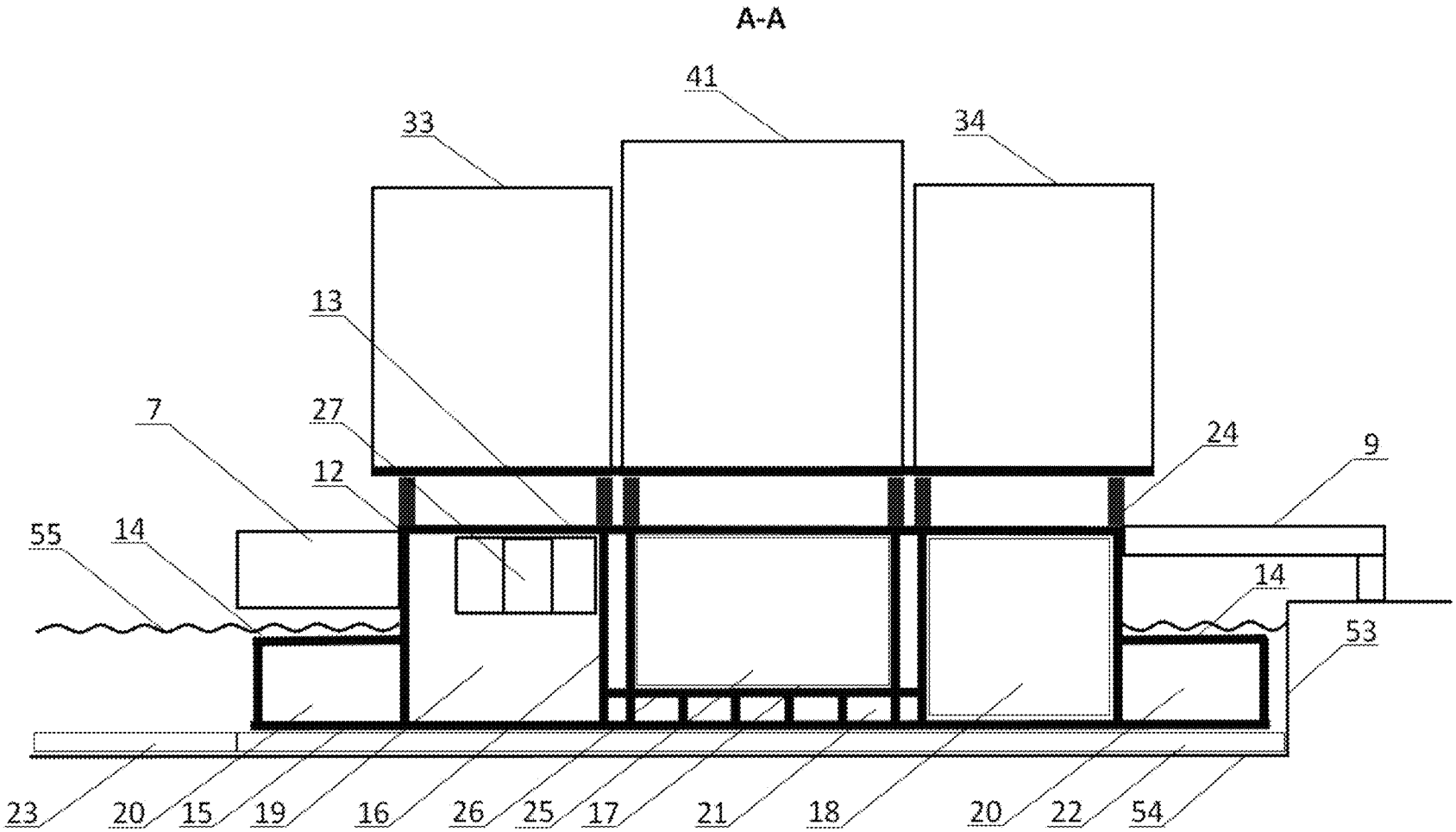
FIG. 3 shows the transverse section A-A for FIG. 1.

The drawings depict a sample complex comprising three production lines 1, 2, 3, each on dedicated GBS 4, 5, 6 (FIG. 1). Each production line 1 (2, 3) together with its respective GBS 4 (5, 6) is a prefabricated product fabricated at a specialized enterprise and then towed afloat to its installation site. Production line 1 (2) on GBS 4 (5) may have jetty 7 (8) to offload the products into tankers (FIG. 2). At the site, GBS 4-6 are installed near specialized quaysides on dedicated underbase foundations 22 on the seabed (FIG. 3, 4). Production lines 1-3 on GBS 4-6 are interconnected by piping and cabling installed on overpasses 9 enabling the integration of production lines 1-3 into a single production complex. Each GBS is also connected to a shore with overpasses and bridges enabling the installation of respective piping and cabling to the shore without resorting to underwater pipelines and/or long overwater overpasses, as well as ease of access to the production complex and swift personnel evacuation. The short distance to the shore enables a simpler and cheaper integration with onshore facilities, including the hydrocarbon field, from which the feedstock is supplied to the production complex.

On the shore near production lines 1-3, high-pressure flare 10 and general economies 11 are installed to be shared by the entire complex (FIG. 1).

Figure 4:
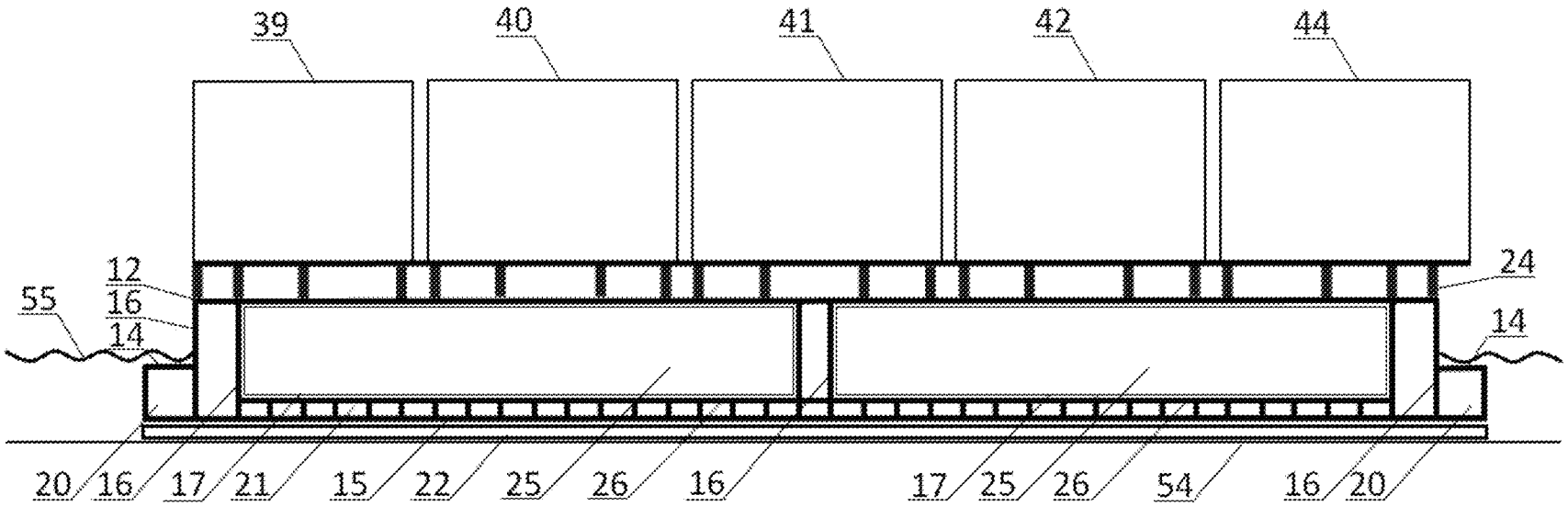
FIG. 4 shows the longitudinal section B-B for FIG. 1.

Each production line 1-3 is a topside (modularized process equipment) on GBS 4-6 (FIGS. 2, 3 and 4). The main process installations, in which the gas treatment and liquefaction process sequence is completed are (FIG. 2): inlet facilities installation 28, including raw gas reception and treatment installations and a gas condensate stabilization installation, gas dehydration installation 29 and mercury removal installation 30, WFLH extraction installation 31 and fractionation installation 32, gas liquefaction installation 33, mixed refrigerant compressors installations 34 and 35, boil-off gas compressors installation 36, fuel gas installation 37, and heating medium system installation 38.

The main process installations on either side of a GBS, as well as power plant 43, emergency diesel generators 44, nitrogen system installation 45, air compressors installations 46 and air dryers installations 47 have pipeline, cable tray and bridge connection via interconnecting modules 39-42.

GBS 4-6 are three-dimensional structures made from reinforced concrete, which function is a storage for extracted and processed raw gas, as well as for auxiliary substances and materials. They underlie the topsides (production lines 1-3) and are designed to be installed on seabed of a water body with the help of their own weight. GBS central part 12 is a rectangular prism with top slab 13 (FIGS. 3 and 4).

On sides of central part 12 along its perimeter, the GBS has protruding part 14 with vertical external walls. GBS central part 12 and protruding part 14 share base slab 15, and protruding part 14 is lower than central part 12.

GBS central part 12 is broken down into compartments with vertical longitudinal and transverse walls 16. Some of the compartments, e.g. compartments 17 and 18, are used for product (LNG and SGC) storage, while other compartments, e.g. compartments 19, 20 and 21, are used for ballast water. GBS protruding part 14 is broken down with vertical walls that are perpendicular to its external walls into compartments 20 along the GBS perimeter, which are also included in the ballast system.

GBS top slab 13 has reinforced-concrete supports 24, on which the topside modules are installed.

GBS 4-6 can stay afloat during water transportation to the site of the integrated production complex and can withstand ice impact in ice conditions. Changing the condition of GBS 4-6 from floating to stationary at the site of installation on the foundation 22 is ensured by flooding ballast compartments 19, 20, 21 with water.

To prevent scouring of the bed under GBS 4-6 and the bed of the water body, seabed reinforcement 23 such as gabions or other similar devices may be placed on the water bed around GBS 4-6 (FIG. 3).

The technological process of the GBS LNG production complex has no fundamental differences from mixed refrigerant-based process technologies, which are used at onshore plants. Each process production line for the liquefaction of natural gas with the use of mixed refrigerant contains inlet facilities installation 28 which includes equipment for receipt and treatment of raw gas, as well as gas condensate stabilization. Raw gas and condensate from the field are piped via overpass 9 to inlet facilities installation 28, in which raw gas reception, pressure control, liquid condensate (hydrocarbons and water) separation, carbon dioxide, hydrogen sulphide, methanol, and other impurities removal from the raw gas, and gas condensate stabilization occur.

Stabilized gas condensate (SGC) is sent to a storage tank with the capacity of approx. 75,000 $m^3$ (FIG. 3). At least one concrete compartment 18 with the dimensions of 135×30×30 m is used as an SGC storage tank, the external structures of which act as a protective barrier. "Wet" storage involving an underlying water layer is used for SGC storage. In this case, the bottom layer of the stored product around 1 m in thickness is considered a mixing zone ensuring guaranteed separation of water and the stored product during loading operations. Compartment 18 is slightly pressurized (from the atmospheric pressure level) using a nitrogen cushion in the upper part of the compartment to prevent air penetration to the compartment and prevent any flammable and explosive gas mixtures with hydrocarbon vapors from forming.

Figure 5:
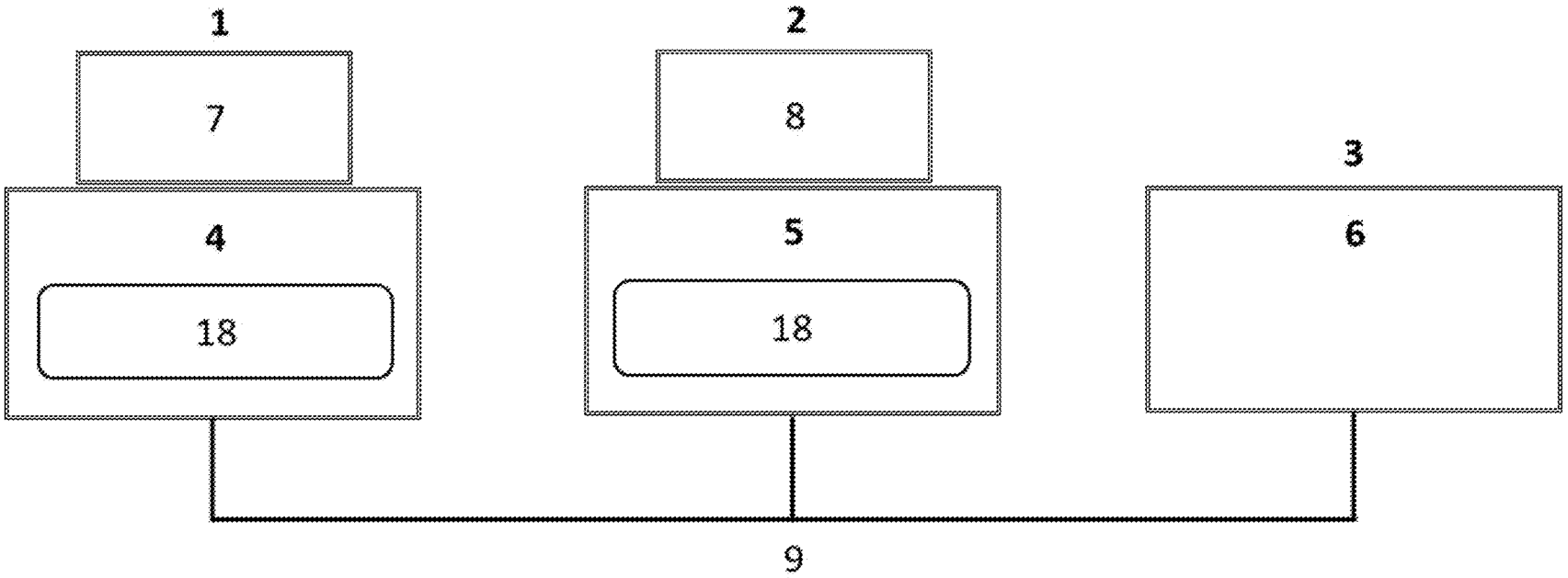
FIG. 5 shows a scheme of the SGC storage and offloading system

SGC storage and offloading system (FIG. 5) is common for the whole production complex, condensate may be pumped between at least two production lines through onshore pipelines, making it possible not to have SGC storage tank(s) in each GBS. If a complex comprises two GBS, SGC storage tanks may be located either in one of them or in both of them. If a complex consists of at least three GBS, said SGC storage tanks shall be placed in at least two GBS, and in this example only in GBS 4 and 5, where SGC is sent for storage also from the third production line 3 which does not have condensate storage tanks.

Treated raw gas is sent to dehydration installation 29 and mercury removal installation 30 sequentially, where mercury, moisture, and remaining methanol are removed from the raw gas before it is sent to wide fraction of light hydrocarbons (WFLH) extraction installation 31. At WFLH extraction installation 31, ethane, propane, butane, and NGL fractions are extracted from the treated gas before it is sent for liquefaction.

At least one production line has WFLH fractionation installation 32. The ethane, propane, and butane produced at said installation are used for the purposes of mixed refrigerant components replenishment. Mixed refrigerant components replenishment system 48 is common for the whole complex. Refrigerant components may be pumped between the production lines through onshore pipelines. If a complex has two GBS and two production lines, the fractionation installation may be placed on either of the production lines or on both of them. If a complex consists of at least three production lines, it will suffice to place fractionation installations on at least two of them. In this example fractionation installations are installed on the first and second production lines 1 and 2 (FIG. 6), where hydrocarbons extracted from gas are fractionated resulting in production of ethane, propane, and butanes fractions. Remaining stabilized heavy hydrocarbons are sent to SGC storage tanks—compartments 18.

Figure 6:
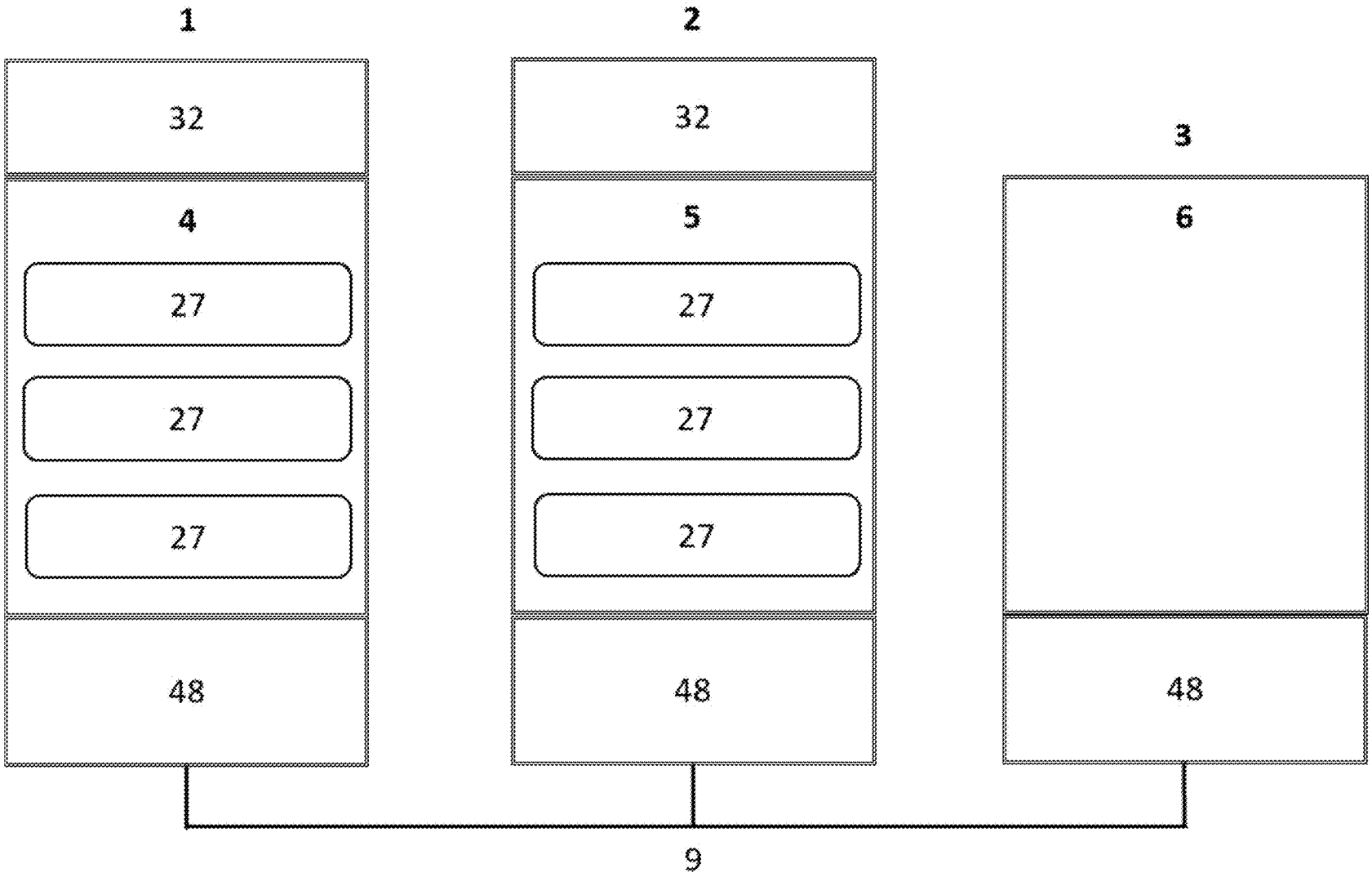
FIG. 6 shows a scheme of a WFLH fractionation and mixed refrigerant components replenishment system.

To store mixed refrigerant components in at least one GBS in case of at least three GBS—in at least two GBS, and in this example in the first and second GBS 4 and 5, separate tanks 27 are provided, at least one for each mixed refrigerant component, used for mixed refrigerant components replenishment at all three production lines 1-3, including at the production line 3 which does not have a fractionation installation and mixed refrigerant components storage tanks (FIG. 6). The WFLH extracted at the third GBS 6 is returned to the flow of treated gas to the liquefaction installation or sent to WFLH fractionation installations installed at GBS 4 or 5. If a complex has two GBS, tanks for each mixed refrigerant component may be located in one or two GBS which have fractionation installation(s). In case of at least three GBS, having fractionation installations and tanks for each mixed refrigerant component at least in two production lines (1 and 2) allows to ensure duplication of this critically important equipment. All tanks 27 for each mixed refrigerant component have pipeline connections to refrigerant treatment and compressions systems of each production line to form single mixed refrigerant components replenishment system 48.

Figure 7:
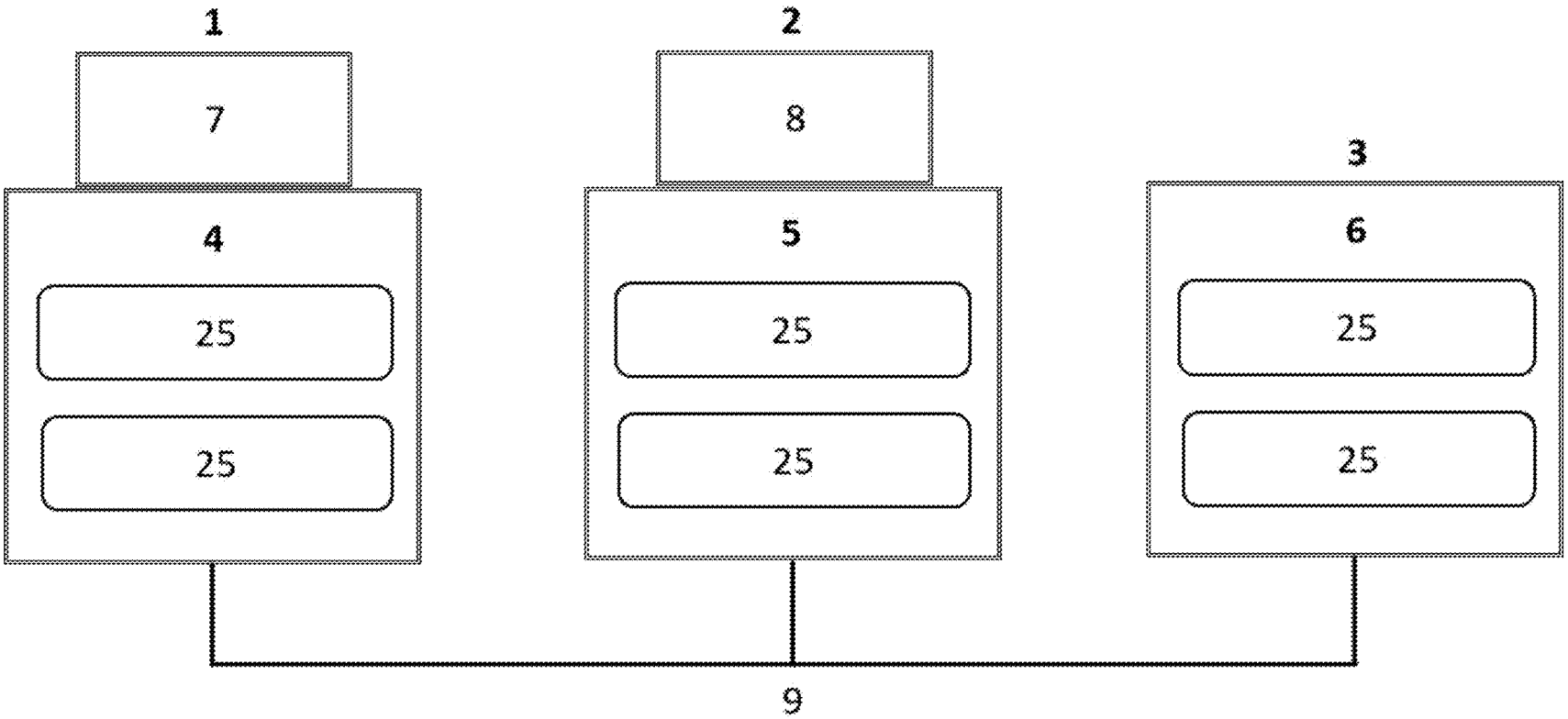
FIG. 7 shows a scheme of a LNG storage and offloading system.

Treated gas is sent to liquefaction installation 33 where three coil-wound heat exchangers are installed one after another, which are used to cool the gas with subsequent throttling and generation of liquefied fraction (LNG) and boil-off gas. Three mixed refrigerants with different composition, which are mixtures of nitrogen, methane, ethane, propane, and butane, are used for gas cooling in the heat exchangers. The liquefied gas is sent to LNG storage tanks 25 accommodated inside each GBS 4-6. LNG storage tanks 25 have a pipeline interconnection to form a single LNG storage and offloading system. The LNG storage and offloading system (FIG. 7, 10) is common for the whole production complex, LNG may be pumped between tanks 25 in various GBS through onshore pipelines, allowing to use the total tank capacity to the maximum.

Each GBS 4-6 accommodates at least one, or preferably two, tanks 25 for storage of LNG with capacity of 115,000 $m^3$ each. Thus, the total capacity of tanks 25 within the production complex amounts to approximately 690,000 $m^3$. Membrane tanks are used for LNG storage. In this case, tank 25 consisting of a steel membrane made of stainless steel or invar (Fe—Ni alloy) separated from concrete structure by an insulation layer is installed inside concrete compartment 17 (FIGS. 3, 4). The insulation layer is placed directly on top slab 13, intermediate slab 26 and GBS walls 16, transferring the loads from tank 25 and its LNG content to the above-mentioned enclosing structures. The GBS slabs and walls thus serve as support structures for membrane tanks 25, with which they are integrated into a single structure. To prevent any leaks, the bottom and the side surfaces of membrane tanks 25 have a secondary barrier being an additional membrane installed inside the insulation layer.

Tanks for storage of ethane, which is a mixed refrigerant component, have similar membrane structure but smaller capacity. GBS 4 and 5 each have one ethane tank with capacity of approximately 1,200 $m^3$ each (FIGS. 3 and 6).

Self-supported tanks installed in GBS 4 and 5 compartments are used for other mixed refrigerant components-butane and propane. Said two GBS 4 and 5 each has one tank for storage of butane with the capacity of 280 $m^3$ each, and one tank for the storage of propane with capacity of 280 $m^3$ each (FIGS. 3 and 6).

Tanks 27 for each mixed refrigerant component are located within a GBS as close as possible to the relevant process installations where these components are used, allowing to optimize the lengths and masses of pipelines, electrical heat tracing, and insulation.

Refrigerant is treated and compressed at mixed refrigerant compressor installations 34 and 35 (FIG. 2). Each of the three mixed refrigerant loops has two parallel strings, A and B, in the form of two separate installations with the capacity of 50% of the full capacity. This allows the production complex to work at 50% capacity even in case of shutdown of half of compressor installations.

Each installation has two compressors on one shaft and on one frame. Each such pair of compressors is driven by one gas turbine drive, which reduces the number of gas turbine drives. All drives have the same capacity and are completely unified, which simplifies their operation and repairs.

Figure 8:
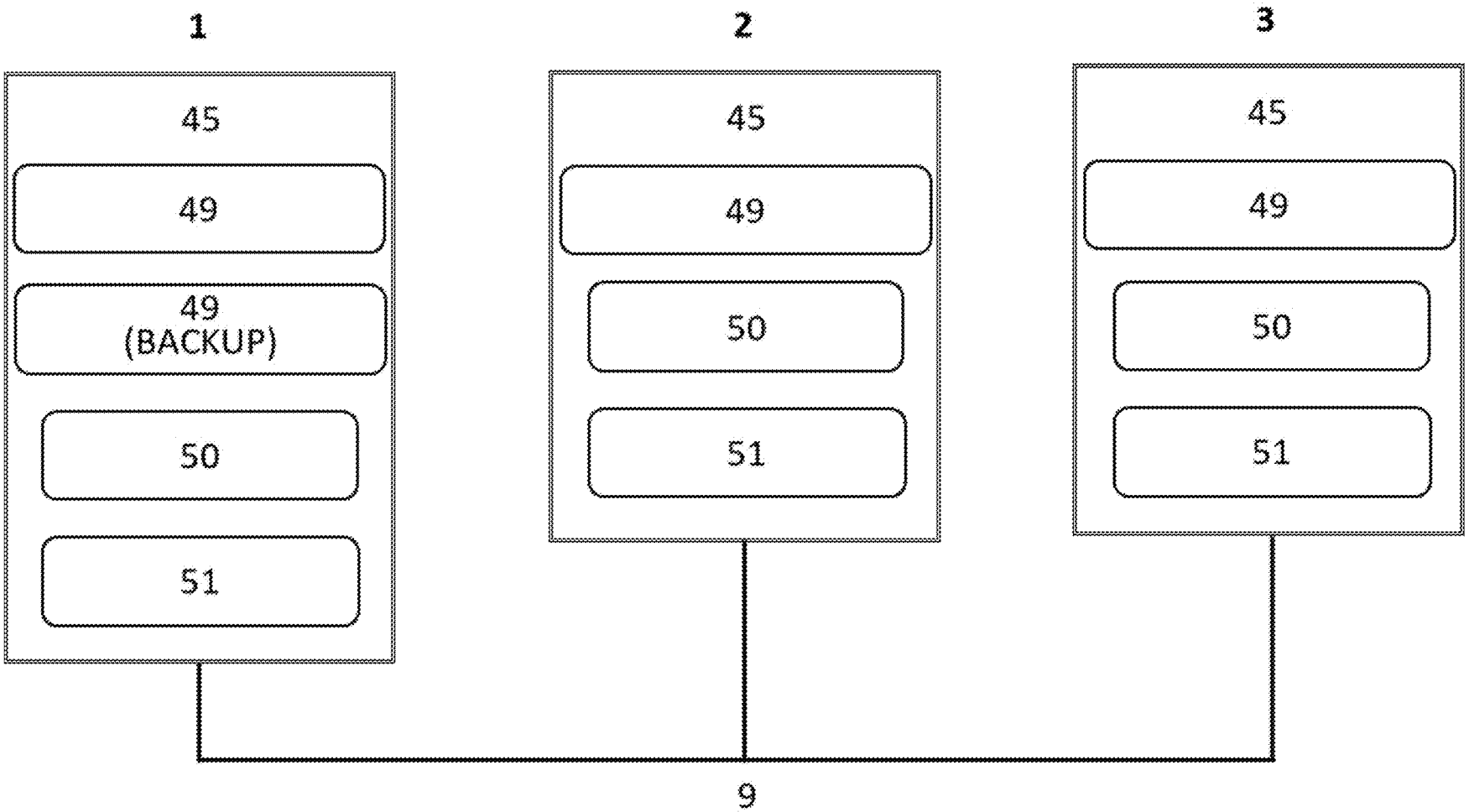
FIG. 8 shows a scheme of the nitrogen system.

Ethane, propane, and butane extracted from WFLH at fractionation installations 32 and stored in tanks 27 for replenishment at GBS 1 and 2 are used to produce the refrigerant. Methane replenishment is done using treated raw gas and boil-off gas. Nitrogen for refrigerant replenishment is produced at comprehensive nitrogen system installation 45, which includes air separation installations 49 with air purification and dehydration systems, liquid nitrogen storage tanks 50, and liquid nitrogen vaporizers 51 (FIG. 8). The production line 1 accommodates comprehensive air separation installations 49 in the 2×100% configuration (one installation in operation, one installation on stand-by), while production lines 2 and 3 are equipped with air separation installations 49 in the 1×100% configuration. Nitrogen production redundancy for the whole production complex is ensured by production line 1 and the ability to pump nitrogen between production lines. Besides mixed refrigerant replenishment, nitrogen is used to create inert medium and gas cushions, purging, compressor dry gas seals, and as back-up source of purge gas.

Boil-off gas generated in liquefaction installation 33, LNG storage tanks 25, and also in the gas carrier's cargo tanks during offloading is sent to boil-off gas compressors installation 36 for boil-off gas compression and distribution. Boil-off gas is partially used for the treatment at fuel gas installation 37, which is primarily consumed by gas turbines in power plant and mixed refrigerant compressors installations.

Figure 9:
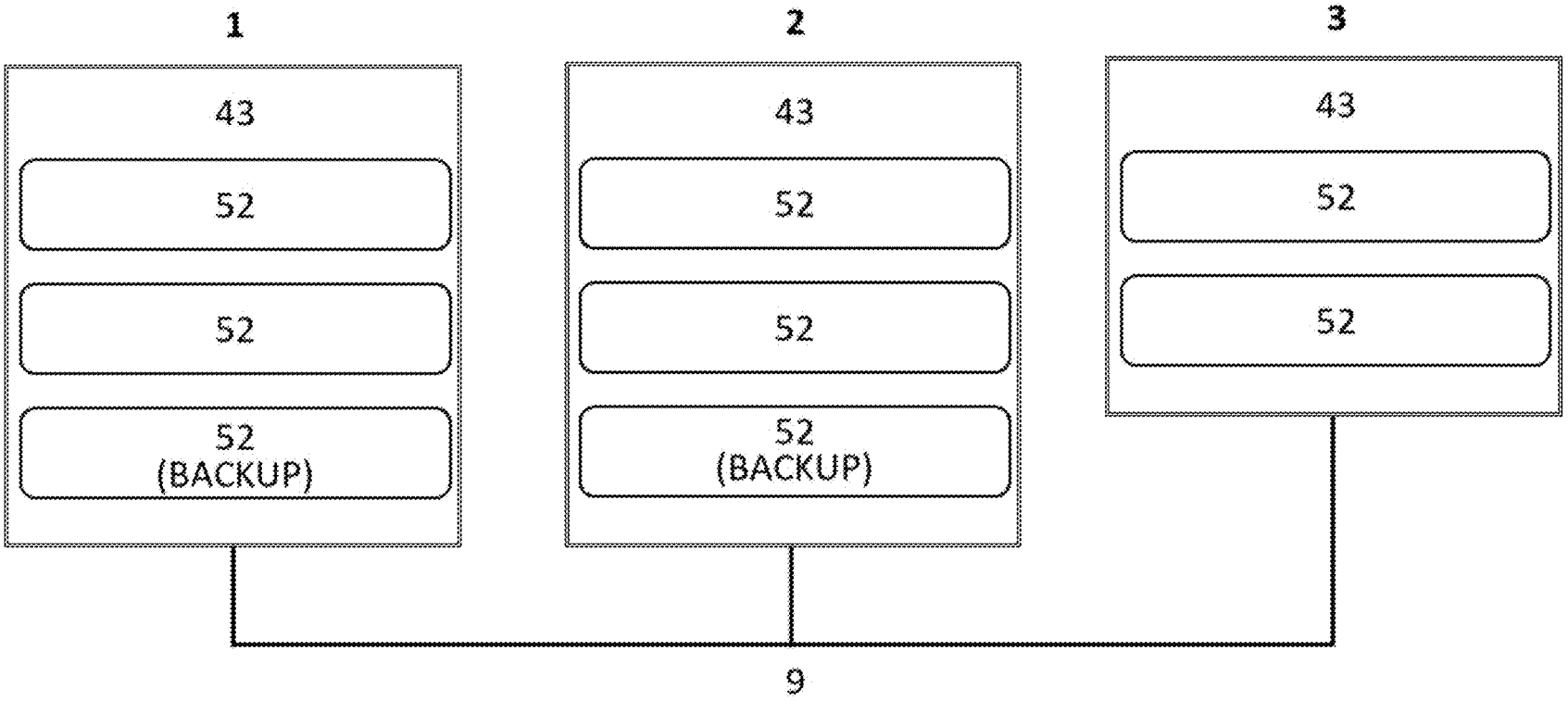
FIG. 9 shows a scheme of the power supply system.

Power supply system is common for the whole production complex (FIG. 9). The system is based on gas turbine power plants 43 within each production line 1-3. Each power plant 43 within the production lines 1 and 2 has three gas turbine generators 52 (GTG), including two in operation and one on stand-by, while production line 3 has two GTGs 52. GTG 52 of the power plant and the turbine drives of mixed refrigerant compressors use unified gas turbines, which makes it easier and cheaper to operate and service the equipment. The gas turbines are equipped with installations to recover waste heat to be used to heat up the heating medium in heating medium system installation 38.

Emergency diesel generators 44 serve as a standby power source. Since power plants 43 across the three production lines are incorporated into a single power supply system with the help of cables running through overpass 9, N+2 power generation sparing arrangement is enabled.

A similar sparing principle is used for the air compressors and air dryers, for which the air supply systems across the three production lines are interconnected.

Figure 10:
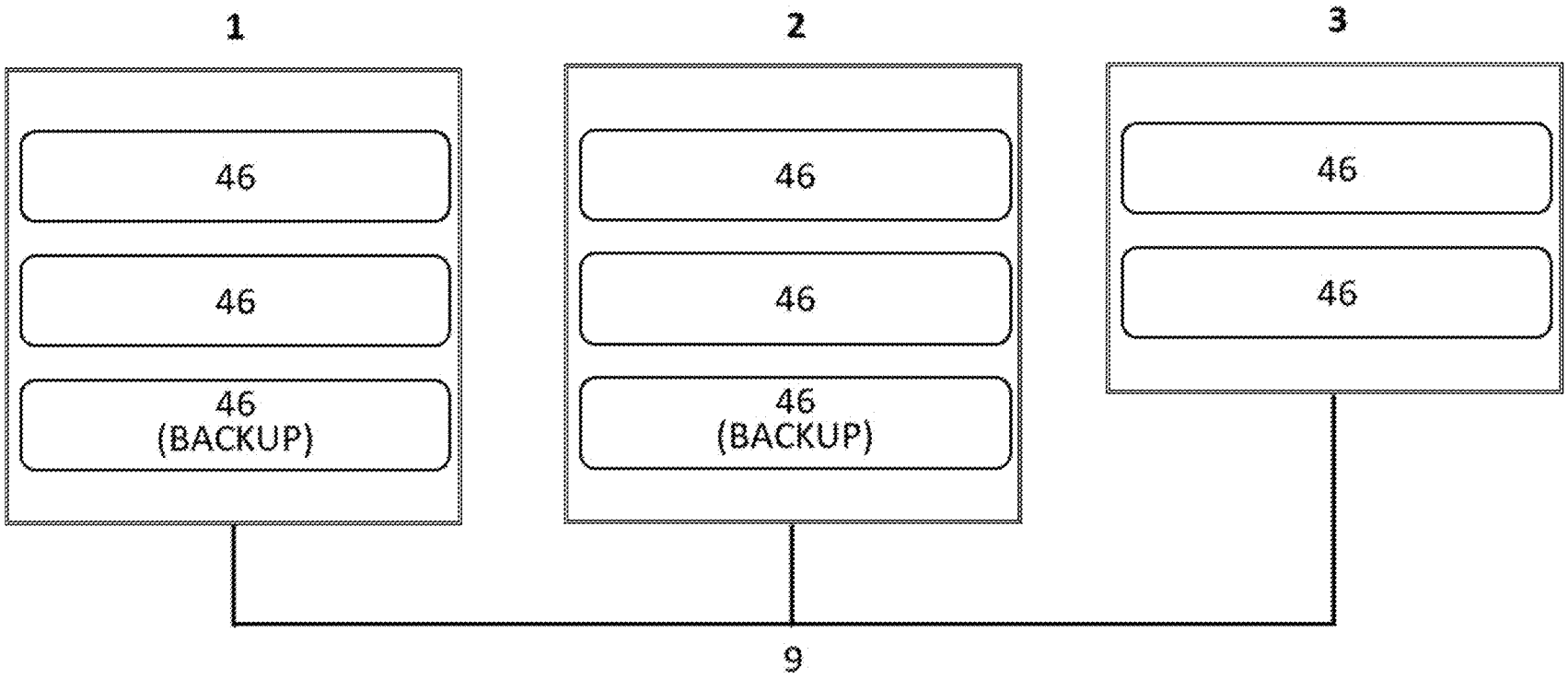
FIG. 10 shows a scheme of the air compressors installations.

On production lines 1 and 2, air compressors installations 46 are installed in a 3×50% arrangement (two in operation, one on standby), whereas air compressor installations 46 of production line 3 are installed in a 2×50% arrangement (FIG. 10). The sparing of air compressors installations of production line 3 is ensured by backup capacities of production lines 1 and 2.

Figure 11:
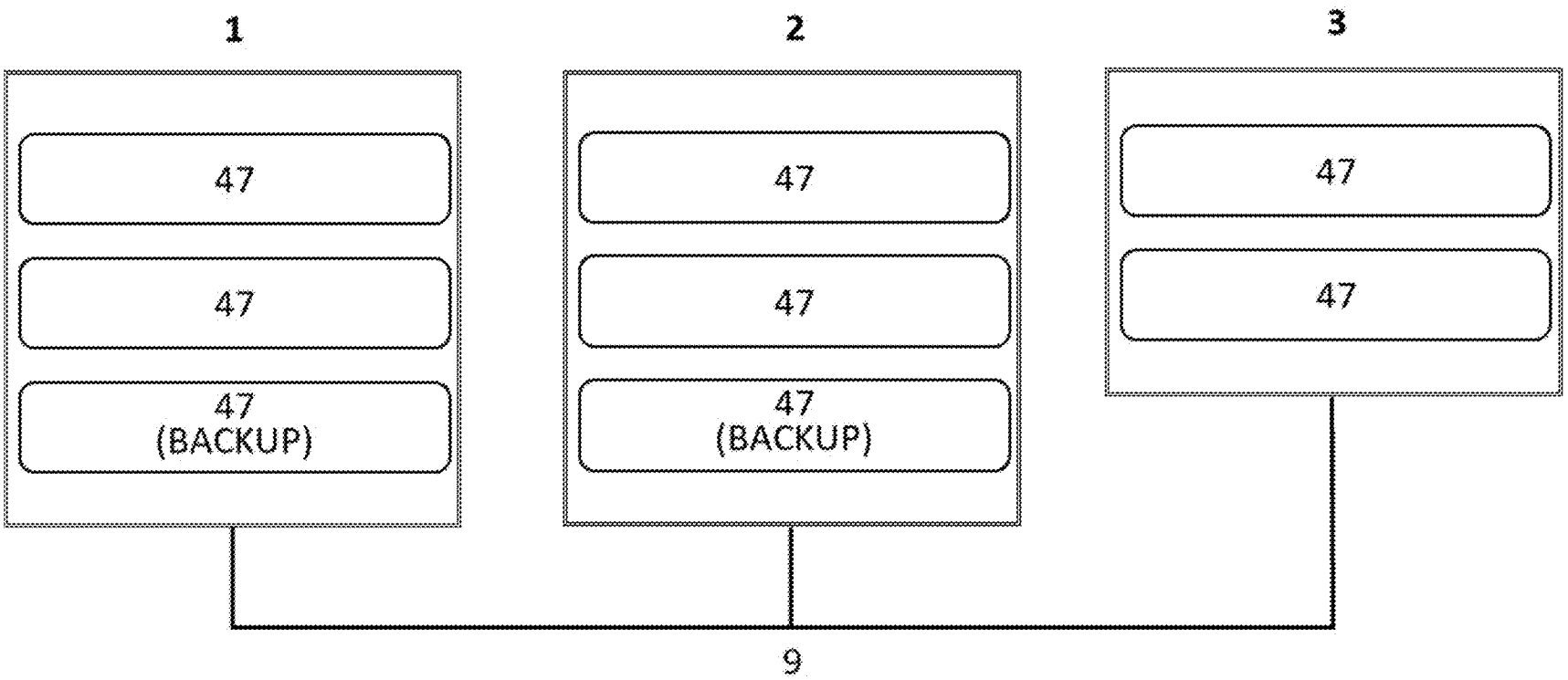
FIG. 11 shows a scheme of the air dryers installations.

Air dryers installations 47 are installed on each production line, with two of them also having backup air dryers installations. On production lines 1 and 2, these installations are installed in a 3×50% arrangement (two in operation, one on standby), whereas the air dryers installations are installed on the production line 3 in a 2×50% arrangement (FIG. 11). The sparing of air dryers installation 47 on production line 3 is ensured by backup air dryers installations 47 of production lines 1 and 2. Dry air is used to build up pressure in the gas turbine engines and to provide barrier air for the couplings of the gas turbine drives of the mixed refrigerant compressors.

LNG is offloaded into tankers for transporting liquefied gas via jetties 7 and 8, which are only installed on certain production lines, for instance on production lines 1 and 2 and GBS 4 and 5 (FIG. 1). Same jetties 7, 8 are used for SGC offloading. Products of production line 3 are offloaded at the jetties of the production lines 1 and 2 via the LNG and SGC storage and offloading systems.

Offloading jetties 7, 8 are structurally integrated into GBS 4, 5 and the topside. Fenders and a technological platform with loading arms as well as other marine and process equipment enabling LNG and SGC offloading are installed on protruding part 14 on the berthing side of the GBS. Mooring equipment for tanker berthing is installed on the GBS berthing side. The water area near jetty 7, 8 may have seabed reinforcement 23 protecting the bottom soil from scouring by ships propellers (FIG. 3).

Production lines 1-3 are interconnected by cables and pipelines running on overpass 9 and the quayside. Same overpass 9 is used to connect the production complex to the field and other onshore facilities.

LIST OF NUMBERS IN DRAWINGS

1. Production line (GBS topside)
2. Production line (GBS topside)
3. Production line (GBS topside)
4. GBS
5. GBS
6. GBS
7. Jetty for tankers
8. Jetty for tankers
9. Interconnecting overpass
10. High-pressure flare
11. Objects of general economy
12. GBS central part
13. Top slab of the GBS central part
14. GBS protruding part
15. GBS base slab
16. GBS vertical wall
17. LNG storage compartment
18. SGC storage compartment
19. Inner ballast compartments
20. Outer ballast compartments
21. Inner ballast compartments under the intermediate support slab of the LNG storage tank
22. GBS underbase foundation
23. Seabed reinforcement
24. Topside support
25. LNG storage tank
26. Support slab for LNG storage tank

27. Mixed refrigerant components storage tanks
28. Inlet facilities installation
29. Gas dehydration installation
30. Mercury removal installation
31. WFLH extraction installation
32. Fractionation installation
33. Gas liquefaction installation
34. Mixed refrigerant compressors installation (line A)
35. Mixed refrigerant compressors installation (line B)
36. Boil-off gas compressors installation
37. Fuel gas installation
38. Heating medium system installation
39. 1st interconnecting module
40. 2nd interconnecting module
41. 3rd interconnecting module
42. 4th interconnecting module
43. Power plant
44. Emergency diesel generators
45. Nitrogen systems installation
46. Air compressors installations
47. Air dryers installations
48. Mixed refrigerant components replenishment system
49. Air separation installation
50. Nitrogen storage tank
51. Nitrogen vaporizer
52. Gas turbine generator
53. Quayside
54. Seabed
55. Water level

The invention claimed is:

1. A liquefied natural gas (LNG) production complex comprising at least two gravity-based structures (GBS), each accommodating a natural gas liquefaction production line using a mixed refrigerant, including raw gas reception and treatment installations, a gas condensate stabilization installation, gas dehydration and mercury removal installations, a wide fraction of light hydrocarbons (WFLH) extraction installation, a refrigerant treatment and compression system, and a liquefaction installation, with at least one GBS production line incorporating a fractionation installation to generate mixed refrigerant components from WFLH, with at least one respective GBS having at least one storage tank for each mixed refrigerant component, with each GBS having at least one LNG storage tank, with at least one GBS having at least one stable gas condensate (SGC) storage tank, with at least one GBS having a jetty for LNG and SGC offloading, wherein at least one of each tank for each mixed refrigerant component has pipeline connections to the refrigerant treatment and compressions systems of each production line to form a single mixed refrigerant components replenishment system, at least one SGC storage tank has a pipeline connection to condensate stabilization installations of each production line to form a single SGC storage and offloading system, and the LNG storage tanks have a pipeline interconnection to form a single LNG storage and offloading system.

2. The complex according to claim 1, comprising two GBS, with the said fractionation installation being installed on one, or each, of the two production lines, and at least one tank for each mixed refrigerant component being installed in one, or each, of the two GBS.

3. The complex according to claim 1, comprising at least three GBS, with the said fractionation installations being installed on at least two production lines, and at least one of each tank for each mixed refrigerant component being installed in at least two respective GBS.

4. The complex according to claim 1, comprising two GBS, with at least one SGC storage tank being installed in one, or each of the two GBS.

5. The complex according to claim 1, comprising at least three GBS, with at least one SGC storage tank being installed in at least two GBS.

6. The complex according to claim 1, comprising at least three GBS, with the LNG and SGC offloading jetties being available at least on two GBS.

7. The complex according to claim 1, wherein each production line comprises a nitrogen system, including an air separation installation, a nitrogen storage tank, and a nitrogen vaporizer, with one of the production lines also having a backup air separation installation, and the nitrogen systems having a pipeline interconnection to form a single nitrogen supply system.

8. The complex according to claim 1, wherein each production line comprises air compressors installations, with two of the production lines having a backup air compressors installation, and the air compressors installations having a pipeline interconnection to form a single compressed air supply system.

9. The complex according to claim 1, wherein each production line comprises an air dryers installation, with two of the production lines having a backup air dryers installation, and the air dryers installations having a pipeline interconnection to form a single dry air system.

10. The complex according to claim 1, wherein each GBS accommodates a power plant, with all the power plants having a cable interconnection to form a single power supply system, each power plant having gas turbine generators (GTGs), and two of the power plants each having a backup GTG.

* * * * *